US005866055A

United States Patent [19]

Schwarz et al.

[11] Patent Number: 5,866,055

[45] Date of Patent: Feb. 2, 1999

[54] PROCESS FOR THE PRODUCTION OF A POLYESTER MULTIFILAMENT YARN

[75] Inventors: Raimund Schwarz, Tomils; Werner Stibal, Chur, both of Switzerland

[73] Assignee: Ems-Inventa AG, Switzerland

[21] Appl. No.: 867,729

[22] Filed: Jun. 2, 1997

[30] Foreign Application Priority Data

Dec. 20, 1996 [DE] Germany ..... 196 53 451.8

[51] Int. Cl.[6] ..... D01D 5/088; D01D 5/092; D02G 3/00

[52] U.S. Cl. ..... 264/103; 264/211.14; 264/211.15; 264/211.17; 264/237

[58] Field of Search ..... 264/103, 211.14, 264/211.15, 211.17, 237

[56] References Cited

U.S. PATENT DOCUMENTS

| | | | |
|---|---|---|---|
| 4,101,525 | 7/1978 | Davis et al. | 528/308.2 |
| 4,195,052 | 3/1980 | Davis et al. | 264/210.5 |
| 4,491,657 | 1/1985 | Saito et al. | 528/308.1 |
| 4,505,867 | 3/1985 | Mirhej | 264/103 |
| 4,990,297 | 2/1991 | Stibal et al. | 264/211.14 |
| 5,536,157 | 7/1996 | Linz | 425/72.2 |

FOREIGN PATENT DOCUMENTS

| | | |
|---|---|---|
| 3629731 | 3/1987 | Germany . |
| 3708168 | 9/1988 | Germany . |
| 2180499 | 4/1987 | United Kingdom . |
| WO 92/15732 | 9/1992 | WIPO . |

OTHER PUBLICATIONS

R. Straub, et al., *Quenching System For Melt Spinning Plants*, Chemical Fibers International (CFI), vol. 45, Oct. 1995, pp. 372, 374 and 376.

*Primary Examiner*—Leo B. Tentoni
*Attorney, Agent, or Firm*—Standley & Gilcrest

[57] ABSTRACT

The present invention pertains to a process for the production of a polyester multifilament yarn having at least 90 mol % ethylene terephthalate with a single filament titer of 1 to 20 dtex, using a central quenching system, characterized in that the method has the following steps: Extrusion of a polyethylene terephthalate polymer melt through a spinneret that has a number of capillaries between 150 and 1500, adjusting a spacer length between 5 and 150 mm, cooling of the obtained threads by means of a constant blown-air speed profile defined in the thread transit direction in that it initially rises very quickly in the region facing the spinneret, then reaches a maximum and subsequently drops off initially very quickly, then more slowly, with the average blown air speed in the vicinity of the threads being between 0.15 and 1.5 m/sec, in such a manner that the undrawn yarn produced from the process has a birefringence of between 0.050 and 0.130, and the coefficient of variation in tenacity at break between the undrawn, single filaments of a yarn amounting to a maximum of 6% with the coefficient of variation in the elongation at break amounting to a maximum of 8%, whereby finally the undrawn yarn is further processed into a finished yarn.

22 Claims, 5 Drawing Sheets

PROCESS FOR THE PRODUCTION OF A POLYESTER MULTIFILAMENT YARN

This application claims the benefit of German Patent Application Serial No. 196 53 451.8 filed on Dec. 20, 1996.

BACKGROUND

The present invention pertains to a method for the production of a polyester multifilament yarn.

High-strength filaments of polyethylene terephthalate (PET) are used, as known, in various facets of industry, e.g., for the manufacture of tire cord.

The invention in particular pertains to a polyester (PET) that contains at least 90 mol % of ethylene terephthalate.

For the use of PET in the above-identified areas, yarns with particularly stable molecular structures are needed. U.S. Pat. No. 4,195,052 describes a method for the production of high-strength PET yarns with low shrinkage and little heat generation under cyclical, mechanical loads. To increase the spin yarn orientation, the process uses a stress elevation by means of a fast cooling of the threads directly beneath the spinning nozzle. As is also indicated from the above patent specification (FIG. 1), within the framework of the method, a counterflow blowing is used. However, in this case, maximum capillary counts of 20 to 34 are disclosed.

A cooling process of this kind and other conventional quenching processes in general lead to nonhomogeneous yarn properties, and thus to an increased filament breakage rate. In particular, when using several hundred capillaries (e.g., more than 200), as the ordinary technician will know, multiple problems occur.

Nonhomogeneous yarn properties are obtained in the otherwise standard cooling processes, particularly when a relatively high and defined spin yarn orientation is required for the use of many capillaries. The latter pertains to special methods for the production of polyester yarns with low shrinkage and large modulus, the so-called low-shrinkage-high-modulus yarns (L.S.H.M. yarns). The nonhomogeneity problems thus increase with a greater the number of filaments at a given single titer. The single filament titer is between 1 and 20 dtex. U.S. Pat. No. 4,491,657 describes the production of a yarn with large modulus and low shrinkage. However, the described method with a conventional cooling technique cannot be transferred to a one-step spin-drawing process owing to the high required spinning speeds. In addition, in the use of a conventional cooling system, particularly when many capillaries are to be used, even in a two-step method (spinning-and drawing separately) the homogeneity of the yarns is limited.

From German Patent No. 3629731 and No. 3708168 it is already known how to achieve a good homogeneity in the mechanical properties. The problem of a simultaneously high molecular orientation in the spin material however is not found to be addressed in these publications. The provision of a high molecular orientation with simultaneous homogeneity of the high capillary spin yarn as a basis of a multifilament for specific use in L.S.H.M. is not found in either German Patent No. 3629731 or even in German Patent No. 3708168.

European Patent No. 0527134 pertains in general to the homogeneous production of filaments by use of a central quenching system. However, the possibilities for the production of yarns with low shrinkage and higher modulus are not recognized in this publication. Furthermore, clearly fewer than 150 capillaries are used in this publication.

In additional studies that form the basis of the present invention, it turned out that, in particular, certain combinations of spacer lengths (spacing between blow candle* and spinneret), lengths of the active and passive part of the central quenching system, the blown air speed, the blown air temperature, and the blown air profile produce definite improvements, specifically with regard to the production and/or the properties of L.S.H.M (low-shrinkage-high-modulus) yarns.

SUMMARY OF THE INVENTION

The problem of the present invention involves making available a process for the production of a polyester multifilament yarn with a particularly stable molecular structure and high homogeneity, even while making available large numbers of capillaries. In this way, a high-quality feeder yarn (yarn exiting the take-up godet wheel) is achieved.

This problem is solved by a process according to claim 1. It is important to set up a defined, stationary blown-air profile, in particular for an optimum adjustment of the desired spin yarn properties.

A high-quality feeder yarn is the basis for a stable process and for a high-quality end product. In contrast to the standard methods used in the production of dimensionally stable yarns, with the present invention, constant and defined yarn properties are achieved, even in spite of large increases in orientation that are achieved by the inventive cooling of an especially high-capillary feeder yarn. For example, the range of fluctuation (variation coefficient $C_v$) in tenacity and elongation at break of the feeder yarn are clearly below those of conventional methods that are already known. However, in conjunction with a simultaneously required large orientation of the feeder yarn, the invention provides significant progress with respect to the run dependability, the maximum possible level of the initial modulus and tenacity at break, and the general consistency of properties. Thus, the financial viability (due to the run dependability with a large number of capillaries) and the titer flexibility of the manufacturing method can be improved.

It turns out that with the use of the applicant's central quenching air system according to this invention on a production scale, it is possible to produce qualitatively premium, high-strength yarns with high initial modulus, low shrinkage, and little heat generation under cyclical, mechanical loads better than with any other previously known cooling system.

In contrast to previously known methods, the central quenching air system (as described below) produces a very homogeneous product. Due to its high homogeneity, a clearly improved yield (run dependability) is observed at the same production velocity, in addition to the improvements in mechanical properties. The described method thus produces a high homogeneity when using very many capillaries and operates much more economically than other, comparable methods (e.g., U.S. Pat. No. 4,195,052).

It surprisingly turns out that the combination of the described activities with a blown air profile that initially rises very quickly in the thread transit direction will attain a maximum and, at the lower end of the blow candle, it decreases at a defined rate, with the result of outstanding and simultaneously very homogeneous L.S.H.M. yarn properties. The blown air profile used according to this invention is modified in comparison to German-Patent No. 3708168 in such a type and manner that the rise of the blown air profile runs significantly steeper, drops off relatively steeply after the maximum and finally runs out less steep. A positive influence is thus exerted on the structure formation process in the spin yarn.

With the method according to this invention, it is possible to obtain greater spin yarn orientations and/or birefringence respectively than that described in European Patent No. 0527134 while simultaneously retaining very homogeneous properties.

Preferably, the spacer spindle is made of a material that has a thermal conductance less than that of steel. The uniformity can be improved even more by the additional heat insulation of the central quenching system, especially of the spindle.

The number of capillaries amounts to 150 to 1500.

Preferably, the number of capillaries amounts to 200 to 1000, more preferably 220 to 800. Particularly prominent advantages have been observed in this range. The spacer length is adjusted between 5 and 150 mm. Preferably, the spacer length is set between 30 to 90 mm. Better economies are achieved in this range. The average quenching air speed is between 0.15 and 1.5 m/sec, measured in the vicinity of the threads. The average quenching air speed is preferably between 0.3 and 0.95 m/sec. Finally, the quenchomg air temperature is preferably between 10° and 30° C.

Additional advantages, properties, and potential applications are obtained from the following description of embodiments in conjunction with the figures.

DETAILED DESCRIPTION OF THE PREFERRED EMBODIMENTS

Figure 1:
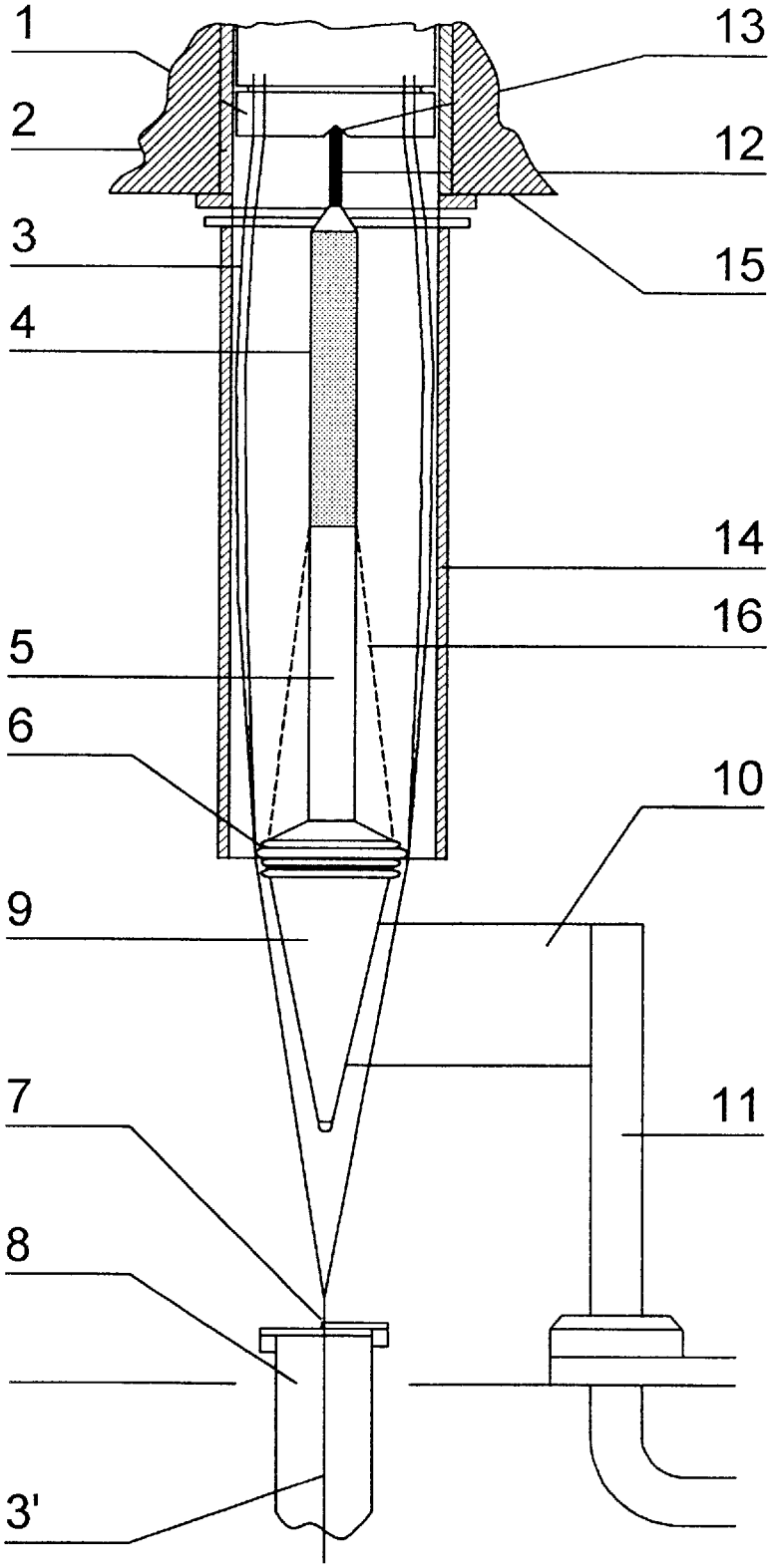
FIG. 1 is a design embodiment of a central quenching air system like that used in the invention.

The invention is predicated on the following definitions.

The crystalline orientation was determined by means of the Hermann orientation function. In this case, the average orientation angle θ was determined by means of wide angle X-ray diffraction. The average value of the angular widths of the reflexes (010) and (100) was used for this.

The crystalline orientation with the average orientation angles becomes:

$$fc=\tfrac{1}{2}(3\cos^2\theta-1)$$

The birefringence Δ was obtained by a measurement with a polarization microscope equipped with a Berek compensator. The crystallinity X (percent by weight) was obtained by conventional density measurements. The amorphous orientation fa was then obtained from the following relation:

$$\Delta n=X*fc*\Delta n_c+(1-X)*f_a\Delta na$$

In this case, $\Delta_{nc}$ is the intrinsic birefringence of the crystallites and $\Delta_{na}$ is the intrinsic birefringence of the amorphous fractions.

The intrinsic birefringences $\Delta n_c$ and $\Delta n_a$ for the polyester were 0.220 and 0.275, respectively (in this regard, see R. J. Samuels, J. Polymer Science, A2, 10,781 (1972)). The amorphous orientation fa was obtained from the birefringence, crystallinity, crystalline orientation, and the intrinsic birefringence.

The final yarn was subjected to a cyclical stress between 0.680 cN/dtex and 0.057 cN/dtex and a temperature of 150° C. In this case, a constant rate of 12.7 mm/min was used for a yarn of 254 mm length. In this case, we normalized the system to a multifilament yarn with a titer of 1111 dtex. The method corresponds to the process known from U.S. Pat. No. 4,101,525.

The shrinkage was measured in hot air at a temperature of 175° C.

The tenacity and initial modulus values were determined according to ASTM D2256.

It turns out that, as indicated in the examples, the described method has an outstanding capability for producing highly capillary, multifilament yarns with a particularly stable internal structure. Characteristic of the undrawn feeder yarn used as the basis in this regard is a birefringence between 0.050 and 0.130 and also a coefficient of variation in the tenacity between the undrawn, single filaments of at most 6%, preferably at most 5%, and a coefficient of variation in the elongation at break of at most 8%, preferably at most 7%.

The intrinsic viscosity in the threads falls between 0.8 and 1.2 dL/g (measured in phenol/tetrachloroethane (1:1) at a temperature of 20° C.).

The capillary holes in the spinnerets used in this regard are positioned on circular rings. The number of capillaries ranges between 150 and 1500. The capillary diameter ranges from 0.25 to 1.2 mm. The temperature of the melt in the spinneret can be set at between 275° and 315° C.

The throughput per capillary amounts to less than 4 g/min.

Beneath the spinneret, the defined solidification of the filaments or threads takes place with the central quenching system described below.

One sample of the inventive central quenching system is schematically presented in FIG. 1. A spin-pack 1 is shown, located within a heating collar 2. Instead of the heating collar, a conventional annealer can also be used. The spin-pack 1 and the heating collar 2 are surrounded by insulation 15. A porous blow candle 4 can be connected in a gastight manner with a sealed tube 5 of variable length.

The diameters of the blow candle 4 and sealed tube 5 are preferably about the same, in this case. In addition, the tube 5 can be surrounded by a conical mantle 16.

A ring-shaped, concentrically positioned finishing device 6 is provided to apply the spinning lubricant onto the filaments 3. The blow candle 4, the sealed tube 5, and the finishing device 6 are supported by a tube cone 9. The tube cone 9 is connected with an inlet channel 10; this, in turn, is connected with the sealed tube 11, which is movably connected to a permanent support. In this case it is possible to extend the entire unit from the thread bundle.

Underneath the tube cone 9, there is a concentrically positioned spinning tube 8. At the upper end of the spinning tube, there is a convergence device 7. The single filaments are combined at this point into one thread 3'. Above the blow candle 4, there is a spindle 12. In the stand-by mode, the spindle engages hole 13 in the spin-pack 1.

The blow candle 4, which has a variable length, as well as the likewise length-variable sealed tube 5 and the finishing device 6, are surrounded by a shield mantle 14. The shield mantle 14 preferably consists of a piece of perforated sheet metal. With a view toward achieving an air exchange with the environment, it is possible to provide a defined distance between heating collar/spinneret and mantle 14 and/or between the finishing device and the shield mantle.

The shield mantle 14 can also be in two parts. When using a two-part design, preferably a defined, upper part of the blow candle and the lower, passive part 5 of the sealed tube are encased.

In addition, the tube 5 can be surrounded by a conical mantle 16.

During operation, the blow candle is supplied with the needed cooling air by means of the tube 11, the inlet 10, the cone 9, the finishing device 6, and the sealed tube 5.

Figure 2:
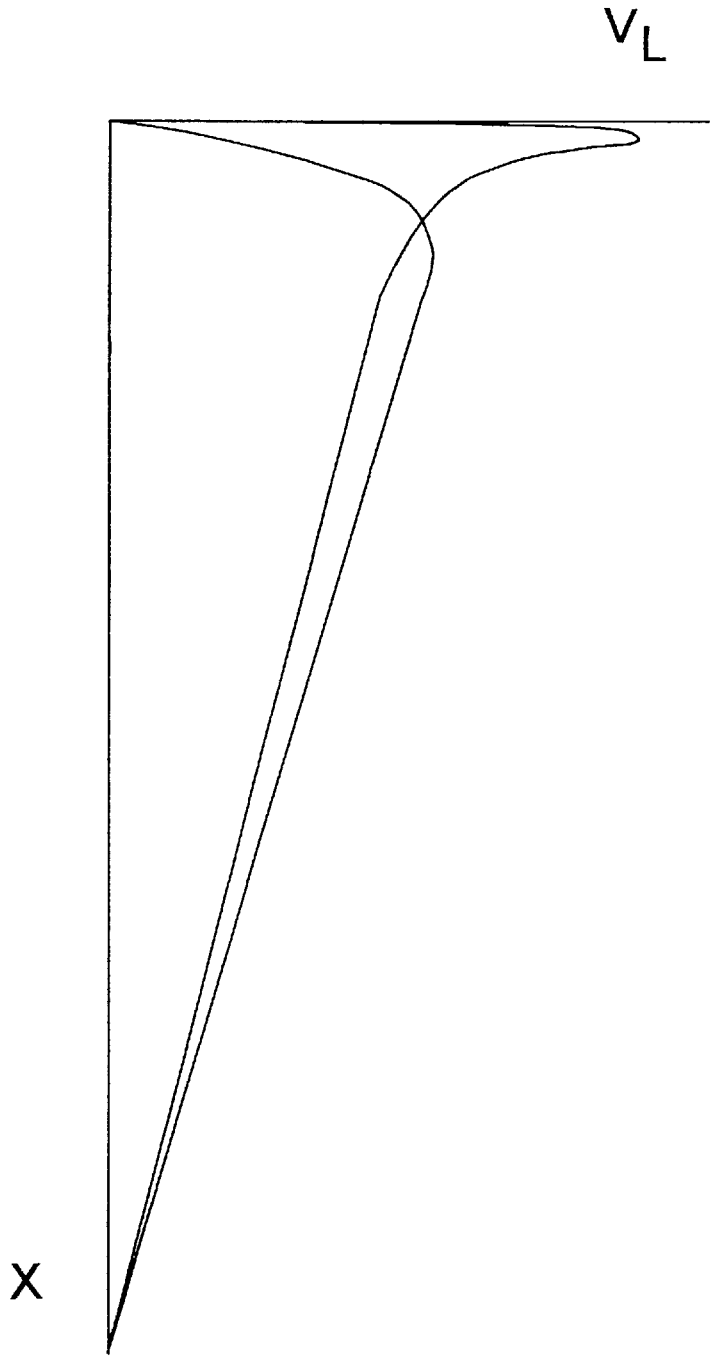
FIG. 2 shows blown air profiles according to the invention and according to the state of the art.

A blown-air speed profile (steep flanks) according to this invention and the profile known from German Patent No. 3708168 are plotted in FIG. 2 for a relative comparison. In this case, the blown-air speed $V_L$ is plotted against the active cooling region (coordinate x). In the production of staple fiber, a very steeply rising blown air profile actually has a negative effect, because the preorientation would be increased and the draw ratio would be reduced, but this would be equivalent to a loss of capacity. In addition, in another sample design, the passive, i.e., not quenching part (sealed tube 5 in FIG. 1, surrounded by mantle 14) of the central quenching system is operated in such a manner that it is possible to subject the filaments to a delayed cooling after reaching a particular temperature.

Figure 3:
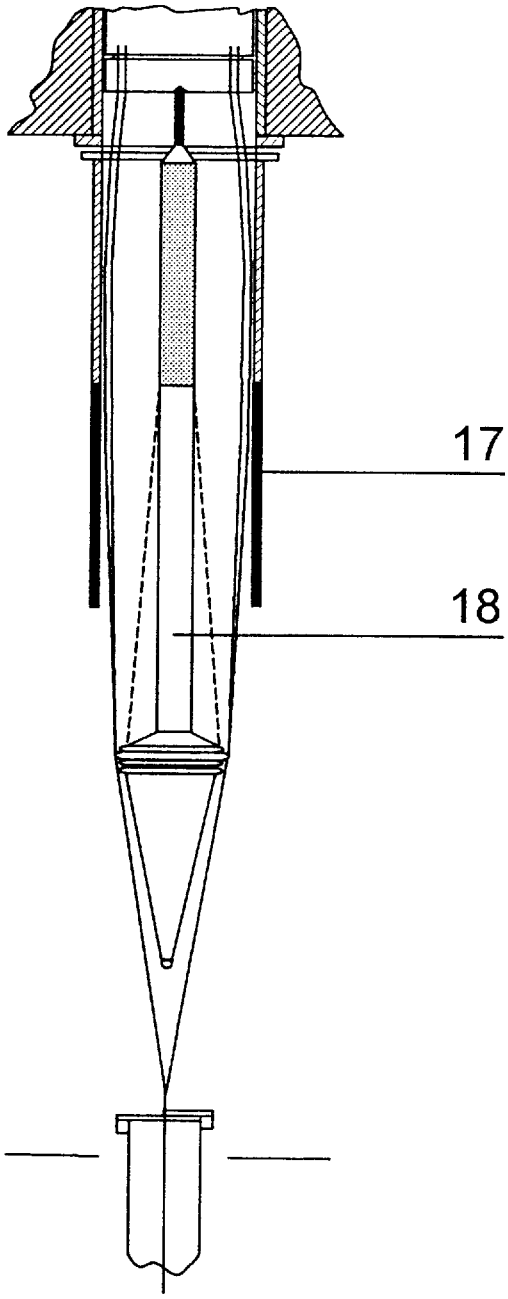
FIG. 3 shows one variant of the central quenching system of FIG. 1.
Figure 4:
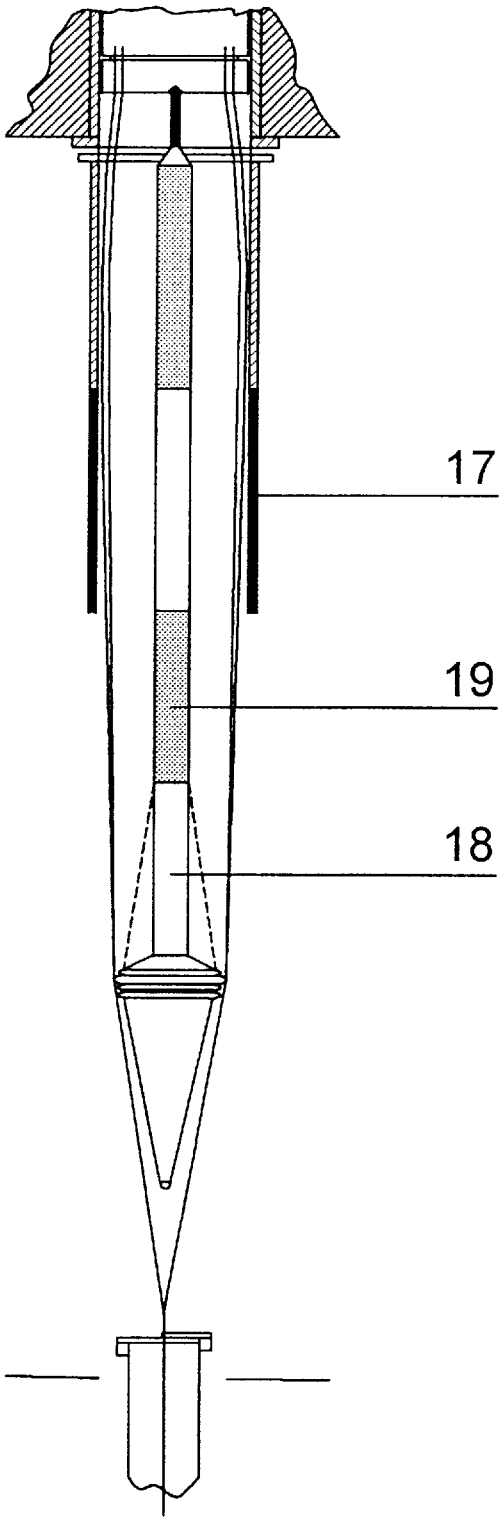
FIG. 4 shows an additional variant of the central quenching system of FIG. 1.

In an additional design embodiment (FIG. 3), the thread bundle is further actively adjusted to a certain temperature in the non-air-quenched region by means of a heated mantle 17 and/or a heated inner tube 5. In this case, the active, that is, air-quenched portion, of the central quenching system can be divided in such a manner that underneath the zone where the thread bundle can be kept at certain temperatures, an additional air quench region can be provided (see 19 in FIG. 4). In this case, the air speeds in the upper and lower portions of the blow candle can be chosen to be specifically different from each other.

In this regard, the defined setting of the spacer intervals (12 in FIG. 1) between 5 and 150 mm has proven to be essential. In particular, the combination of spacer distance, blown air profile, blown air speed, possibly the blown air temperature and the lengths of the active and passive portions of the central quench air system, in conjunction with a large number of capillaries, forms the basis for adjusting the desired yarn properties. This plays an important role with regard to the production of yarns with low shrinkage and large modulus.

The thread bundle exiting from the solidification zone (central quenching system) is taken up by a puller element. The take-off speeds are usually between 2000 and about 5500 m/min at winder speeds normally ranging between about 4000 and 7500 m/min.

The type and manner of drawing the special spins yarns, which are the base product for drawn yarns with particularly stable internal structures have long been known or are state of the art. A detailed description is found in U.S. Pat. No. 4,101,525.

An oriented feeder yarn is usually drawn in several steps between various duo machines, then relaxed again in a defined manner (between 1 and 8%), with the properties of the feeder yarn representing the basis for obtaining a particularly stable structure in the drawn yarn, as was explained in detail above. Usually 3–4 duo machines are used for this (schematically illustrated in FIG. 5). These are used within the framework of the present invention.

In addition, it is also possible (within the framework of a production process for L.S.H.M. yarns not previously described) to replace the last duo machine, and the otherwise attendant intermingling, with the applicant's H4S-(steam)-chamber (schematically shown in FIG. 6), which can be used simultaneously for relaxing and for intermingling. In this case, warm, as well as cold godet duo machines, as described in the applicant's Swiss Patent No. 623,611, can be used.

EXAMPLES 1 AND 2 OF THIS INVENTION:

The spinneret used in this case contained 400 capillary holes arranged on circular rings. The melt temperature was 295° C. The final titer was 1460/400 dtex, the capillary diameters were 0.6 mm, and the intrinsic viscosity of the filaments was 0.89 dL/g. The extruded filaments passed through a spacer length of 40 mm, then passed through the previously described region of the blow candle 4 in FIG. 1. There they were subjected to a controlled solidification with an average blown air speed of 0.76 m/min and a blown air temperature of 29° C. across the blow candle length of 495 mm. After the solidification, a spin finish was applied by means of the finishing ring 6 in FIG. 1. After passing the finishing ring 6 in FIG. 1, the threads ran across a first take-up godet wheel, through the drawing and relaxing unit (duo machines in FIG. 5), then onto the winder.

Figure 5:
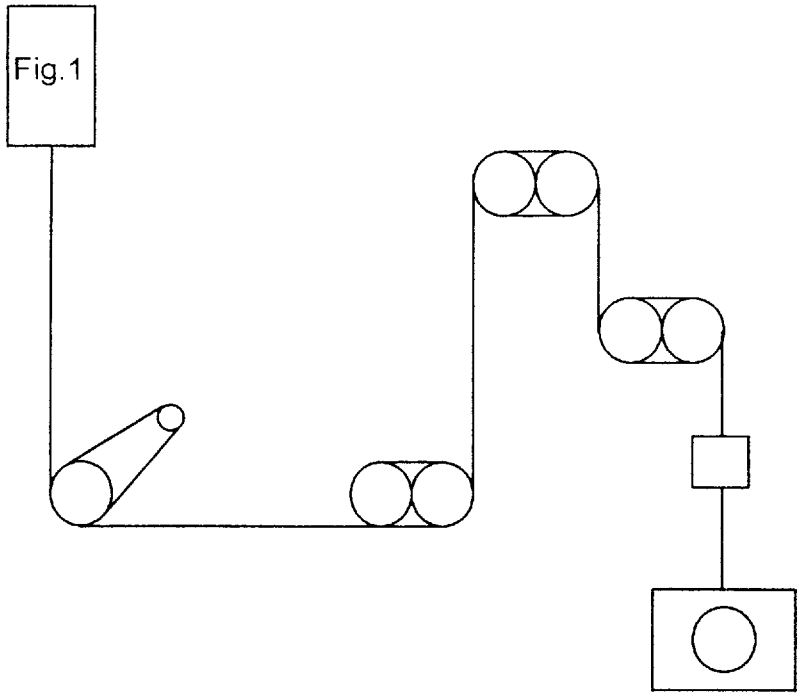
FIG. 5 shows the further processing of the thread or yarn obtained in FIG. 1.
Figure 6:
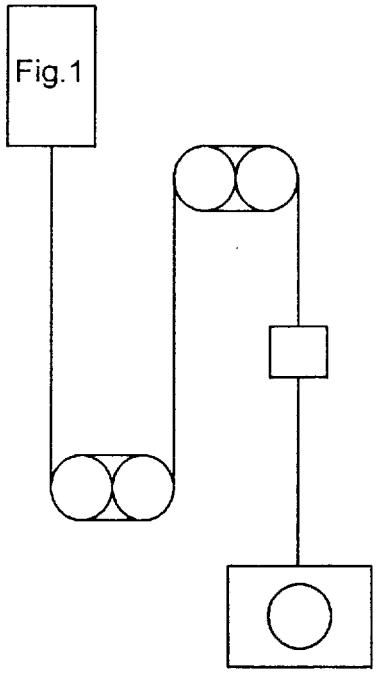
FIG. 6 shows an alternative further processing of the thread or yarn compared to FIG. 5.

FIG. 5 and FIG. 6 are schematic drawings that represent one example for the design in which the subsequent treatment takes place. The type and manner of drawing is described in the state of the art and is known. In particular, with regard to FIG. 6, it should be pointed out that, as already mentioned, the final godet wheel duo machine and the intermingling in FIG. 5 can be replaced by the applicant's H4S-chamber.

COMPARATIVE EXAMPLE 3:

The procedure is the same as in Example 2, but here a cross-flow quenching air is used instead of the central quenching system (see Table I).

COMPARATIVE EXAMPLES 4 AND 5:

The procedure is the same as in Example 2, but with changed spacer lengths (see Table I).

Table I shows a compilation of the measured results of the spinning yarn with the associated coefficient of variation in tenacity at break ($C_v$-RF) and elongation at break ($C_v$-BD), the birefringence Δn and the take-up speed (v(spin)) for all examples.

In addition, the measured values of the stretched yarns are compiled, i.e., tenacity at break RF, initial modulus, crystalline orientation fc, amorphous orientation fa, crystallinity X (percent by weight), birefringence Δn, work loss, and shrinkage. In addition, the used spacer length was presented.

In Table I we clearly see the homogeneity of the filaments of the invention's Examples 1 and 2 - - - much improved in comparison to Examples 3 to 5 - - - expressed in the significantly improved $C_v$-values for tenacity and elongation at break.

TABLE 1

| Spinngarn/Bsp.① | 1 | 2 | 3 | 4 | 5 |
|---|---|---|---|---|---|
| Doppelbrechung② | 0,0760 | 0,0652 | 0,0641 | 0,0410 | 0,0492 |
| v(spinn)(m/min)③ | 2950 | 2500 | 2500 | 2500 | 2500 |
| $C_v$ - RF(%) | 3,5 | 4,2 | 8,1 | 10,1 | 8,3 |
| $C_v$ - BD(%) | 5,2 | 6,6 | 10,1 | 12,2 | 9,9 |

TABLE 1-continued

| Endgarn(4) | | | | | |
|---|---|---|---|---|---|
| RF (cN/dtex) | 9,89 | 9,98 | 9,36 | 9,39 | 9,30 |
| Anfangsmodul (cN/dtex)(5) | 172 | 164 | 150 | 144 | 148 |
| fc | 0,972 | 0,974 | 0,970 | 0,959 | 0,968 |
| fa | 0,493 | 0,505 | 0,517 | 0,584 | 0,562 |
| Kristallinität (%)(6) | 4,71 | 4,69 | 4,78 | 4,67 | 4,70 |
| Doppelbrechung(2) | 0,1725 | 0,1742 | 0,1782 | 0,1842 | 0,1820 |
| Arbeitsverlust (cN*mm)(7) | 194,0 | 204,6 | 221,5 | 248,6 | 239,6 |
| Dehnung (%)(8) | 7,48 | 7,52 | 7,60 | 7,71 | 7,74 |
| Schrumpf (%)(9) | 4,8 | 5,1 | 5,1 | 5,5 | 5,4 |
| Spacer (mm)(10) | 40 | 45 | (11) Querstrom, 45 mm | 190 | 160 |

KEY:
1 Spinning yarn/example
2 Birefringence
3 Spin
4 Final yarn
5 Initial modulus
6 Crystallinity
7 Work loss
8 Elongation at break
9 Shrinkage
19 Spacer
11 Cross-flow

We claim:

1. A method for the production of a polyester multifilament yarn having at least 90 mol % of ethylene terephthalate with a single filament titer in the range of 1 to 20 dtex, by use of a central quench air system comprising a blow candle with a spacer, and a spinneret, said method having the following steps:

(a) extruding a polyethylene terephthalate polymer melt through said spinneret having a number of capillaries between 150 and 1500;

(b) adjusting said spacers to a length between 5 mm and 150 mm, so as to obtain extruded polyester threads; and (c) cooling said extruded polyester threads from said spinneret beginning at the upper end of the active part of the blow candle after said spacer by means of a constant blown-air speed profile defined in relation to the thread transit direction in that it initially rises in the region of the upper end of the active part of the blow candle, then reaches a maximum and subsequently drops off with a slope angle smaller than in the rising part of the profile, then with a slope angle smaller than in the first decreasing part of the blown-air speed profile, whereby the average blown air speed in the vicinity of the threads is between 0.15 and 1.5 m/sec, in such a manner that the non-stretched yarn produced from said process has a birefringence of between 0.050 and 0.130, with the coefficient of variation in tear strength between the non-stretched, single filaments of a yarn amounting to a maximum of 6% and with the coefficient of variation in the tear elongation amounting to a maximum of 8%; whereby said non-stretched yarn is further processed into a finished polyester multifilament yarn.

2. The method according to claim 1, wherein said coefficient of variation in tear strength between the non-stretched single filaments of said yam extends to a maximum of 5% and said coefficient of variation in the tear elongation extends to a maximum of 7%.

3. The method according to claim 1 wherein said spacer comprises a spacer spindle, said spacer spindle consisting of a material that has a thermal conductance less than that of steel.

4. The method according to claim 1 wherein said polyethylene terephthalate polymer melt is supplied from an extruder.

5. The method according to claim 1 wherein said polyethylene terephthalate polymer melt is continuously supplied to said spinning nozzle from a reactor and is spun directly.

6. The method according to claim 1 wherein the cooling in the vicinity of the filament bundle, after transiting a quench air zone, is delayed by means of a device selected from the group consisting of a sealed tube, an active insulation of the mantle, an active insulation of the internal sealed tube, and combinations thereof.

7. The method according to claim 2 wherein the cooling in the vicinity of the filament bundle, after transiting a quench air zone, is delayed by means of a device selected from the group consisting of a sealed tube, an active insulation of the mantle, an active insulation of the internal sealed tube, and combinations thereof.

8. The method according to claim 3 wherein the cooling in the vicinity of the filament bundle, after transiting a quench air zone, is delayed by means of a device selected from the group consisting of a sealed tube, an active insulation of the mantle, an active insulation of the internal sealed tube, and combinations thereof.

9. The method according to claim 4 wherein the cooling in the vicinity of the filament bundle, after transiting a quench air zone, is delayed by means of a device selected from the group consisting of a sealed tube, an active insulation of the mantle, an active insulation of the internal sealed tube, and combinations thereof.

10. The method according to claim 5 wherein the cooling in the vicinity of the filament bundle, after transiting a quench air zone, is delayed by means of a device selected from the group consisting of a sealed tube, an active insulation of the mantle, an active insulation of the internal sealed tube, and combinations thereof.

11. The method according to claim 6 wherein, in conjunction with said delayed cooling, there is a subsequent zone in which the thread bundle is cooled.

12. The method according to claim 1 wherein a steam chamber is used during further processing for relaxation and simultaneous intermingling.

13. The method according to claim 2 wherein a steam chamber is used during further processing for relaxation and simultaneous intermingling.

14. The method according to claim 3 wherein a steam chamber is used during further processing for relaxation and simultaneous intermingling.

15. The method according to claim 4 wherein a steam chamber is used during further processing for relaxation and simultaneous intermingling.

16. The method according to claim 5 wherein a steam chamber is used during further processing for relaxation and simultaneous intermingling.

17. The method according to claim 6 wherein a steam chamber is used during further processing for relaxation and simultaneous intermingling.

18. The method according to claim 1 wherein the number of capillaries is between 200 and 1000.

19. The method according to claim 1 wherein the number of capillaries is between 220 and 800.

20. The method according to claim 1 wherein said spacers are adjusted to a length of between 30 mm and 90 mm.

21. The method according to claim 1 wherein said average blown air speed in the vicinity of said threads is between 0.3 and 0.95 m/sec.

22. The method according to claim 1 wherein the blown air temperature is 10° C. to 30° C.

* * * * *

UNITED STATES PATENT AND TRADEMARK OFFICE

CERTIFICATE OF CORRECTION

PATENT NO. : 5,866,055

DATED : February 2, 1999

INVENTOR(S) : Schwarz, et al.

It is certified that error appears in the above-indentified patent and that said Letters Patent is hereby corrected as shown below:

In Table 1, Column 7, line 9 beginning with the word "Kristallinität" please delete the number "4,71" and replace it with -- 47,1 --; please delete the number "4,69" and replace it with the number -- 46,9 --; please delete the number "4,78" and replace it with the number -- 47,8 --; please delete the number "4,67" and replace it with the number -- 46,7 --; please delete the number "4,70" and replace it with the number -- 47,0 --.

Signed and Sealed this

Twenty-eighth Day of September, 1999

*Attest:*

Q. TODD DICKINSON

*Attesting Officer*

*Acting Commissioner of Patents and Trademarks*